US006437706B2

(12) United States Patent
Sato et al.

(10) Patent No.: US 6,437,706 B2
(45) Date of Patent: Aug. 20, 2002

(54) TOLL COLLECTION SYSTEM AND ITS COMMUNICATION METHOD

(75) Inventors: Yoshihito Sato; Manabu Kato, both of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/793,770

(22) Filed: Feb. 27, 2001

(30) Foreign Application Priority Data

Feb. 28, 2000 (JP) ..... 2000-055995

(51) Int. Cl.[7] ..... G08G 1/00
(52) U.S. Cl. ..... 340/928; 340/917; 340/933
(58) Field of Search ..... 340/928, 905, 340/917, 933, 935, 937; 455/107, 446, 447

(56) References Cited

U.S. PATENT DOCUMENTS 5,227,803 A * 7/1993 O'Connor et al. ..... 342/442
5,710,556 A * 1/1998 Nishimura et al. ..... 340/928
5,751,227 A * 5/1998 Yoshida et al. ..... 340/928
5,805,082 A * 9/1998 Hassett ..... 340/928
6,081,718 A * 6/2000 Ando et al. ..... 340/928
6,109,525 A * 8/2000 Blomqvist et al. ..... 340/928

FOREIGN PATENT DOCUMENTS

JP 7-239954 9/1995
JP 10-214359 8/1998

* cited by examiner

*Primary Examiner*—Van Trieu
(74) *Attorney, Agent, or Firm*—Kenyon & Kenyon

(57) ABSTRACT

An electronic toll collection system (ETCS) for use in a tollgate for charging a car without the need for the car to stop, in which communication failures or errors due to reflected waves from a structure or a passing car are prevented. A roadside communication antenna which communicates with a vehicle-mounted communication antenna for charging, and a car sensor which detects a car (cars) in an area wider than a designed communication area are installed at the tollgate. As an electromagnetic wave path judgment section obtains data on the profile and position of a car which has entered the tollgate, from a car data detector, it calculates electromagnetic wave paths of direct and reflected waves which connect the roadside communication antenna 21 and the vehicle-mounted antenna in each of the cars, and calculates the receiving electric field strength for each of the paths. The direction of the path which has the highest field strength among the paths to the car in the communication area is selected as radiation direction and the direction of the other paths as radiation direction; then the directional pattern which makes the radiant intensity in radiation direction the maximum and that in radiation direction null is determined to control the radiation direction of the antenna unit through a directivity controller.

14 Claims, 11 Drawing Sheets

FIG. 9A 1530-1

| CAR TYPE | LENGTH | HEIGHT | WIDTH | PROFILE DATA |
|---|---|---|---|---|
| CAR TYPE 1 | L 1 | H 1 | W 1 | car1.dat |
| CAR TYPE 2 | L 2 | H 2 | W 2 | car2.dat |
| CAR TYPE 3 | L 3 | H 3 | W 3 | car3.dat |
| CAR TYPE 4 | L 4 | H 4 | W 4 | car4.dat |
| CAR TYPE 5 | L 5 | H 5 | W 5 | car5.dat |
| CAR TYPE 6 | L 6 | H 6 | W 6 | car6.dat |
| CAR TYPE 7 | L 7 | H 7 | W 7 | car7.dat |
| CAR TYPE 8 | L 8 | H 8 | W 8 | car8.dat |

FIG. 9B

| | VERTEX 1 | VERTEX 2 | VERTEX 3 | VERTEX 4 |
|---|---|---|---|---|
| PLANE 1 | x11, y11, z11 | x12, y12, z12 | x13, y13, z13 | x14, y14, z14 |
| PLANE 2 | x21, y21, z21 | x22, y22, z22 | x23, y23, z23 | x24, y24, z24 |
| PLANE 3 | x31, y31, z31 | x32, y32, z32 | x33, y33, z33 | x34, y34, z34 |
| PLANE 4 | x41, y41, z41 | x42, y42, z42 | x43, y43, z43 | x44, y44, z44 |
| PLANE 5 | x51, y51, z51 | x52, y52, z52 | x53, y53, z53 | x54, y54, z54 |

FIG. 9C 1530-2

| CAR TYPE | PATTERN DATA | PROFILE DATA |
|---|---|---|
| CAR TYPE 1 | car1.ptn | car1.dat |
| CAR TYPE 2 | car2.ptn | car2.dat |
| CAR TYPE 3 | car3.ptn | car3.dat |
| CAR TYPE 4 | car4.ptn | car4.dat |
| CAR TYPE 5 | car5.ptn | car5.dat |
| CAR TYPE 6 | car6.ptn | car6.dat |
| CAR TYPE 7 | car7.ptn | car7.dat |
| CAR TYPE 8 | car8.ptn | car8.dat |

FIG. 9D

| i | ii | iii |
|---|---|---|
| 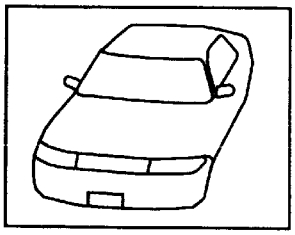 | 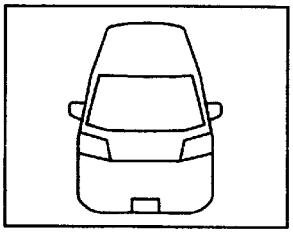 | 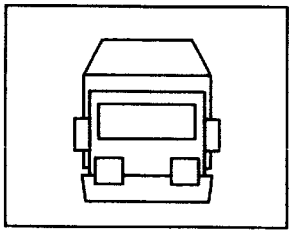 |
| car1.ptn | car2.ptn | car3.ptn |

FIG. 10A

1531

| PATH POINT POSITION | x1 | x2 | x3 | x4 |
|---|---|---|---|---|
| CAR TYPE 1 | path11.dat<br>dipat11.dat | path12.dat<br>dipat12.dat | path13.dat<br>dipat13.dat | path14.dat<br>dipat14.dat |
| CAR TYPE 2 | path21.dat<br>dipat21.dat | path22.dat<br>dipat22.dat | path23.dat<br>dipat23.dat | path24.dat<br>dipat24.dat |
| CAR TYPE 3 | path31.dat<br>dipat31.dat | path32.dat<br>dipat32.dat | path33.dat<br>dipat33.dat | path34.dat<br>dipat34.dat |
| CAR TYPE 4 | path41.dat<br>dipat41.dat | path42.dat<br>dipat42.dat | path43.dat<br>dipat43.dat | path44.dat<br>dipat44.dat |
| CAR TYPE 5 | path51.dat<br>dipat51.dat | path52.dat<br>dipat52.dat | path53.dat<br>dipat53.dat | path54.dat<br>dipat54.dat |
| CAR TYPE 6 | path61.dat<br>dipat61.dat | path62.dat<br>dipat62.dat | path63.dat<br>dipat63.dat | path64.dat<br>dipat64.dat |
| CAR TYPE 7 | path71.dat<br>dipat71.dat | path72.dat<br>dipat72.dat | path73.dat<br>dipat73.dat | path74.dat<br>dipat74.dat |
| CAR TYPE 8 | path81.dat<br>dipat81.dat | path82.dat<br>dipat82.dat | path83.dat<br>dipat83.dat | path84.dat<br>dipat84.dat |

FIG. 10B path11.dat

| | RADIATION DIRECTION | DIRECT/ REFLECTED | RECEIVING FIELD STRENGTH |
|---|---|---|---|
| PATH 1 | $\theta 1$, $\phi 1$ | DIRECT | P1 |
| PATH 2 | $\theta 2$, $\phi 2$ | REFLECTED | P2 |
| PATH 3 | $\theta 3$, $\phi 3$ | REFLECTED | P3 |
| PATH 4 | $\theta 4$, $\phi 4$ | REFLECTED | P4 |
| PATH 5 | $\theta 5$, $\phi 5$ | REFLECTED | P5 |

FIG. 11 path11.dat

1532

| | AMPLITUDE | PHASE |
|---|---|---|
| ELEMENT 1 | A1 | P1 |
| ELEMENT 2 | A2 | P2 |
| ELEMENT 3 | A3 | P3 |
| ELEMENT 4 | A4 | P4 |
| ELEMENT 5 | A5 | P5 |
| ELEMENT 6 | A6 | P6 |
| ELEMENT 7 | A7 | P7 |
| ELEMENT 8 | A8 | P8 |
| ELEMENT 9 | A9 | P9 |

TOLL COLLECTION SYSTEM AND ITS COMMUNICATION METHOD

BACKGROUND OF THE INVENTION

1. Field of the Invention

This invention relates to an electronic toll collection system based on radio communications for a tollgate, and particularly relates to a communication method suitable for the radio environment of a tollgate.

2. Description of Related Art

An electronic toll collection system (ETCS) is an electronic system that enables drivers at a tollgate on a turnpike such as an expressway to receive tickets or pay their tolls without stopping their cars.

FIGS. 2A and 2B show an outline of a tollgate which uses an ETCS. FIG. 2A is a perspective view and FIG. 2B is a top view. The tollgate 300 is demarcated from the neighboring gate zone by an island 311. A roadside communication antenna 21 is installed on the tollgate 300. As a car 31 with a vehicle-mounted communication antenna enters a designed communication area 350, necessary information for charging is exchanged between the roadside communication antenna 21 and the vehicle-mounted communication antenna 22 through radio signals and the car 31 can pass through the tollgate without a stop.

If a car which has no vehicle-mounted communication antenna 22 enters the tollgate area, a car sensor 321 detects its entry and, if no communication with the roadside communication antenna 21 occurs, the car is considered as having no vehicle-mounted communication antenna 22 and the driver must receive a ticket from toll collection personnel in the tollgate booth 301 or pay the toll to him or her.

In this system, if a car with a vehicle-mounted communication antenna enters the tollgate area and no communication is established, the car must stop temporarily. Conversely, if a car without a vehicle-mounted communication antenna enters the zone and a communication between the roadside antenna and the vehicle-mounted communication antenna of another car is established, the former car can pass through the tollgate without paying the toll. Therefore, in order to ensure that tolls are collected without fail, it is proposed that the designed communication area should be set to allow only one car to enter it and there should be a means to enable communication only with the vehicle-mounted communication antenna which is present in it, or disable communication with any vehicle-mounted communication antenna outside it.

For example, the toll collection system disclosed in J-P-A-No.40433/1998 uses a roadside communication antenna which irradiates electromagnetic wave beams with high directivity; and J-P-A-No. 214359/1998 discloses a system in which a car type detector is installed at the front of the tollgate and the directional pattern of electromagnetic wave beams of the roadside communication antenna is varied depending on the car type for the purpose of suppressing communication area variation caused by variation in the position (vertical) of a vehicle-mounted communication antenna.

Another type of proposal is that the roadside antenna should be selected depending on the car's position or height, or depending on the car's height and speed (J-P-A-No.315283, 5/1992 and J-P-A-No.239954/1995).

In the conventional toll collection systems, in order to ensure that each communication is established with only one car at a tollgate, attention is paid only to the directional range of direct electromagnetic wave beams but the influence of reflected waves in the communication area is not taken into consideration.

As shown in FIG. 2A, actually there are structures such as a sound-proof wall 201 and a roof 221 in the tollgate area. As the roadside communication antenna 21 irradiates an electromagnetic wave beam, not only direct radio wave 210 which comes directly from the antenna 21 reaches the vehicle-mounted communication antenna 22 in the car 31, but also reflected wave 211 from the roof 221 and reflected wave 212 from the sound-proof wall 201 may be generated. Since the vehicle-mounted communication antenna 22 receives a radio signal as the direct wave combined with the reflected waves, the direct wave 210 may be offset by the reflected waves 211 and 212 even within the directional range of the electromagnetic wave beam and thus there may be a zone where the radio signal cannot be received. Such a zone momentarily changes depending on the position, speed and other factors of the car 31 and the next car 32.

Besides, even when the vehicle-mounted communication antenna 23 in the next car 32 is outside the directional range of the roadside communication antenna 21, the next car 32 may receive reflected waves from the structures in the tollgate area and/or the car 31 ahead, generating a path of reflected waves 213, which means establishment of communication with a car outside the designed communication area. In this case, because the roadside communication equipment cannot distinguish between the car 31 and the next car 32, if the communication with the latter is established before establishment of communication with the former, the equipment would mistake the communicating car 32 for the car 31 and, therefore, may allow the car 31 to pass through the gate without communication with it or without charging it. The frequency of such mistakes will be higher if there are more cars without vehicle-mounted communication antennas which enter the designed communication area.

As mentioned above, the communication area in conventional ETCSs is designed on the premise of transmission and reception of direct radio waves or at most once reflected wave from the ground, so reflected waves which vary depending on the entering car or other factors may make communication in the designed communication area impossible or make communication outside the area possible. This leads to the problem of low stability and low reliability in radio wave transmission and reception for toll collection.

Also, a special tollgate structure and a wide gate are required to decrease reflected waves. In addition, a specific communication means for each tollgate may be needed because different tollgates have different electromagnetic field environments. This results in a higher construction or operating cost.

SUMMARY OF THE INVENTION

The present invention has been made in view of the above circumstances and provides a toll collection system which electronically collects tolls with accuracy using special software to ensure stable communication with a car in the designed communication area while the radio environment in the tollgate area varies depending on the car position, and also provides its communication method.

The present invention concerns a toll collection system which charges cars which pass through a tollgate without a stop, by means of radio communication. The system is composed of the following devices installed at the tollgate: a roadside antenna whose directional pattern is variable;

roadside communication equipment including a communication controller, which communicates with cars and the host system; and a car sensor which detects the position and profile of the car going to pass through the gate. In the system, taking it into consideration that the radio communication environment as mentioned above is influenced by reflected waves which vary depending on the car's position and profile, the environment for communication between the roadside antenna and the vehicle-mounted antenna in the designed communication area is maintained suitable for automatic toll collection.

For this purpose, the system is characterized in that plural paths of direct and reflected waves which connect the roadside antenna with the antenna in the car present in a given area (car detection area) including the communication area are found and one path which maximizes the sensitivity of communication with the car in the communication area is selected from among them, then the directional pattern of the roadside antenna is so adjusted as to suit the direction of radiation (radiation direction 1) for the selected radio wave path. Also the directional pattern is controlled so that radio communication is impossible with respect to a wave path radiation direction (radiation direction 2) other than radiation direction 1, namely so that the radiant intensity for radiation direction 1 is maximized (or more than intensity 1) and that for radiation direction 2 is null.

If the presence of more than one car in the car detection area is detected, plural paths of direct and indirect radio waves for each car are calculated and all paths of radio waves from/to any car outside the car detection area are treated as having the radiation direction 2.

Regarding the radio wave paths, the system calculates paths of direct waves and all reflected waves available for communication that connect the roadside antenna with the vehicle-mounted antenna whose position depends on the position of the detected car, according to the known reflecting surface data based on the tollgate structure and the reflecting surface data which varies depending on the car profile. A radio wave path for direct waves can be geometrically calculated from data on both the antennas and the reflecting surface data, while ones for reflected waves can be calculated by a numerical method based on radio wave data. Alternatively, it is also possible to calculate paths for different car profiles in advance on the assumption that a car is in the position of one of plural path points which are preset in the car detection area.

The process for calculating the radio wave paths begins when a car enters the communication area, and is repeated for every cycle of detection of the car or every path point. As radio communication with the car in the communication area is over, the process may be once ended.

If radio communication with the car in the communication area is not established, the system considers the car as not having a vehicle-mounted antenna adequately. This means that if communication is impossible even though the communication environment is good, the system considers that the car has no vehicle-mounted antenna or the vehicle-mounted antenna is not ON, judges the car unsuitable for automatic toll collection, and treats it as such, for example, by giving a warning.

As described above, according to the present invention, toll collection can be performed with accuracy because the influence of reflected waves from a tollgate structure or an approaching car on radio waves between the roadside antenna and vehicle-mounted antenna is avoided and a desirable radio wave path for communication with a car in the designed communication area is thus obtained with stability. Since the influence of reflected waves is avoided by adjusting the antenna directivity, restrictions on the tollgate structure can be relaxed and the tollgate construction or operating cost can be reduced.

BRIEF DESCRIPTION OF THE DRAWINGS

Preferred embodiments of the present invention will be described in detail based on the followings, wherein:

FIGS. 9A, 9B, and 9C are tables showing the data structures for the car type data memory and FIG. 9D illustrates car patterns;

FIGS. 10A and 10B are tables showing the data structures for the path memory; and FIG. 11 is the data structure for a directional pattern table.

DETAILED DESCRIPTION OF THE PREFERRED EMBODIMENTS

Figure 2A:
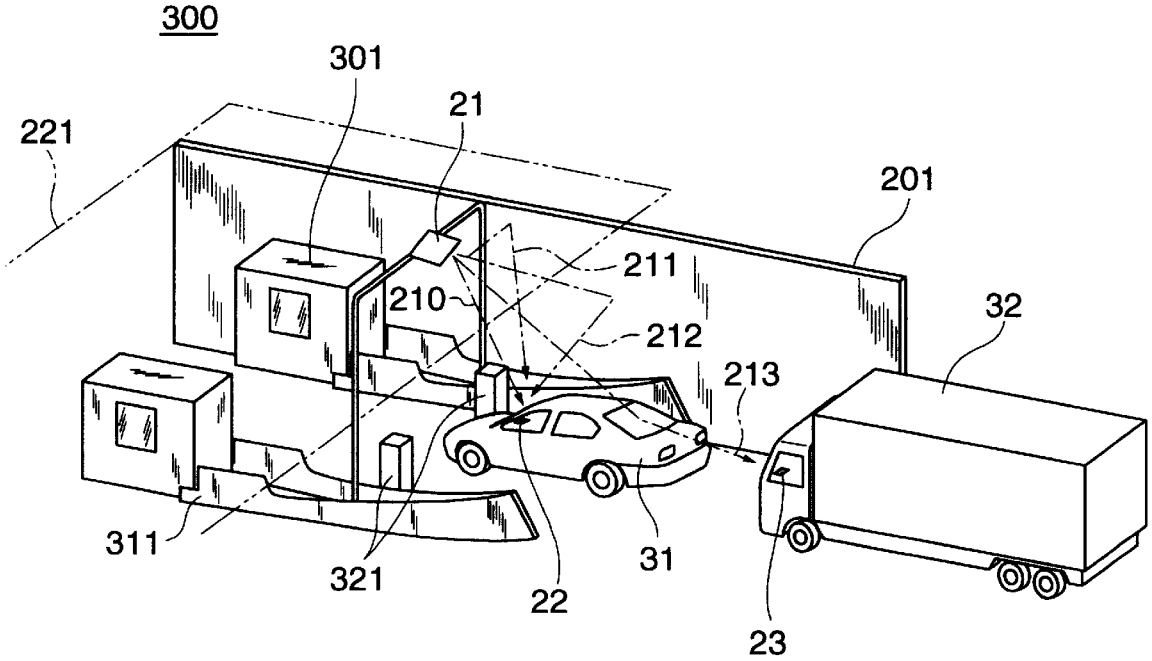
FIGS. 2A and 2B illustrate the outline of a conventional ETCS and its problems.
Figure 2B:
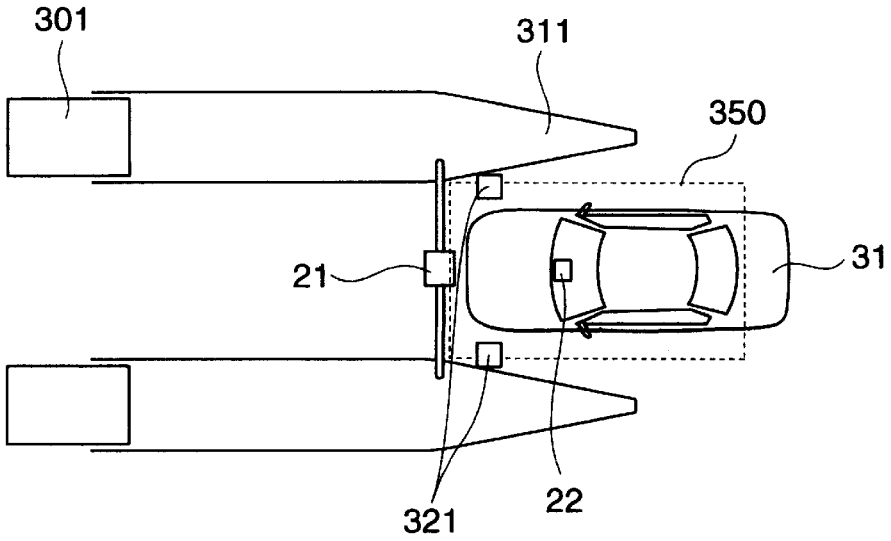
Figure 3A:
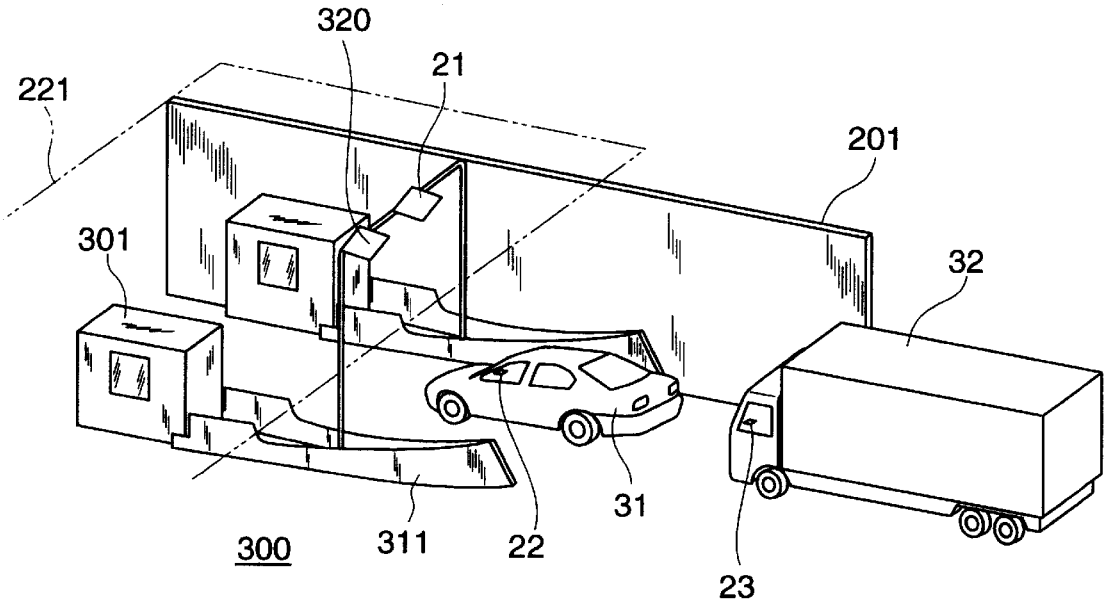
FIGS. 3A and 3B illustrate the outline of a tollgate to which the present invention is applied.

FIG. 3 shows one example of a tollgate system to which the present invention is applied. In a tollgate 300, a roadside antenna 101 and a car sensor 320 are installed overhead or on either side in the tollgate area and the other constituent parts are the same as shown in FIG. 2. Plural such tollgates are installed in the tollgate zone.

Figure 1:
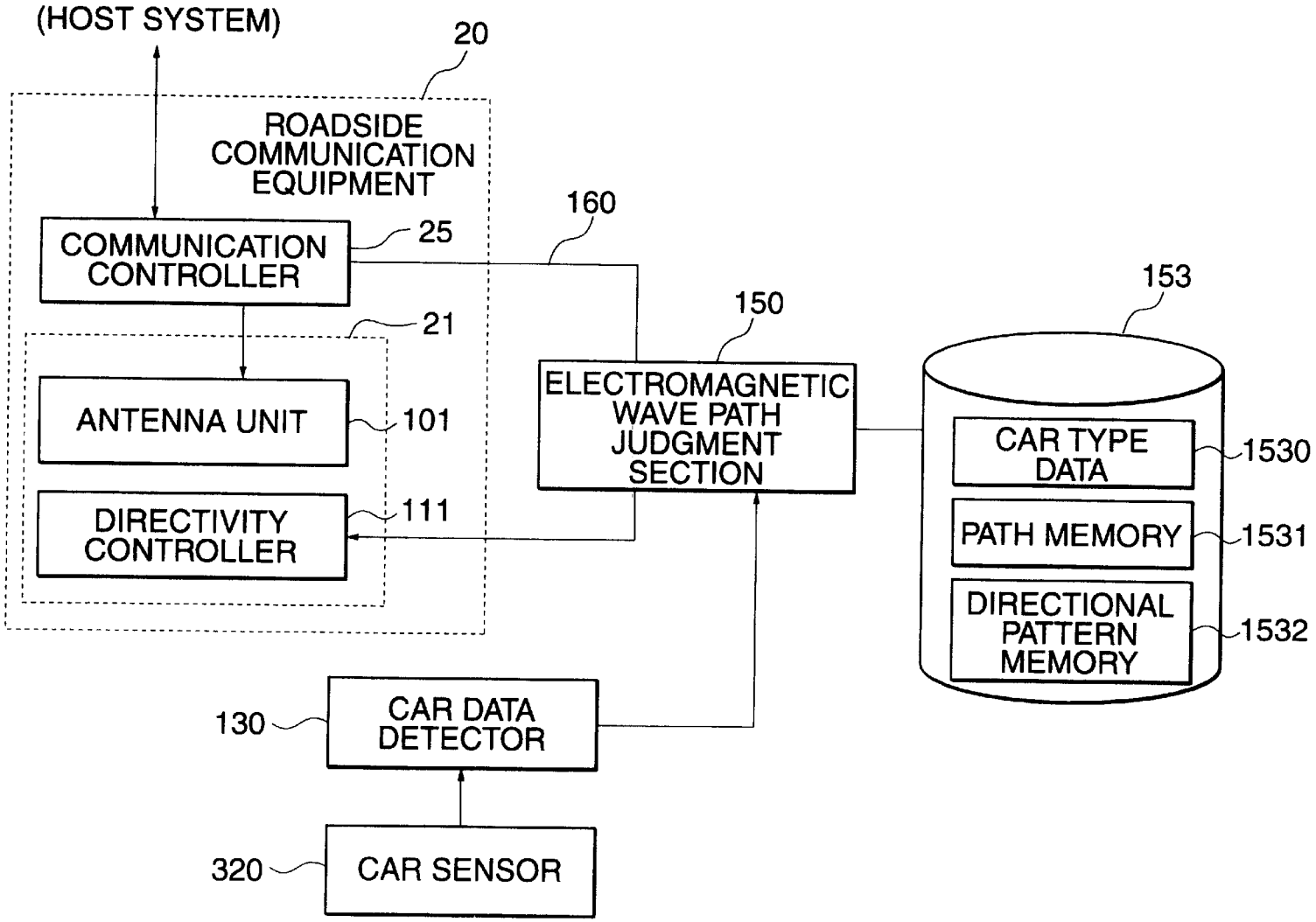
FIG. 1 is a block diagram for a toll collection system according to one embodiment of the present invention.

FIG. 1 shows the structure of a toll collection system according to one embodiment of the present invention. The toll collection system has the following: a roadside communication antenna 21 composed of an antenna unit 101 and a directivity controller 111 for controlling its directional pattern; a communication controller 25 for communication of necessary information for charging with a vehicle-mounted communication antenna 22 by radio signals; a car sensor 320 which detects a car entering the tollgate; a car data detector 130 which determines the position and profile of the detected car; an electromagnetic wave path judgment section 150 which selects an electromagnetic wave path between the antenna unit 101 and the vehicle-mounted antenna 22 and decides the directional pattern for the beam emitted from the antenna unit 101; and a storage 153 which stores car type data 1531 which is referred to for electromagnetic wave path judgment, and contains a path memory 1531 and a directional pattern memory 1532. It is also possible that the roadside communication equipment 20 has a roadside communication antenna 21, a communication controller 25 and a car sensor 320 and the other components are mounted on the host system which interconnects tollgates at different locations.

Figure 3B:
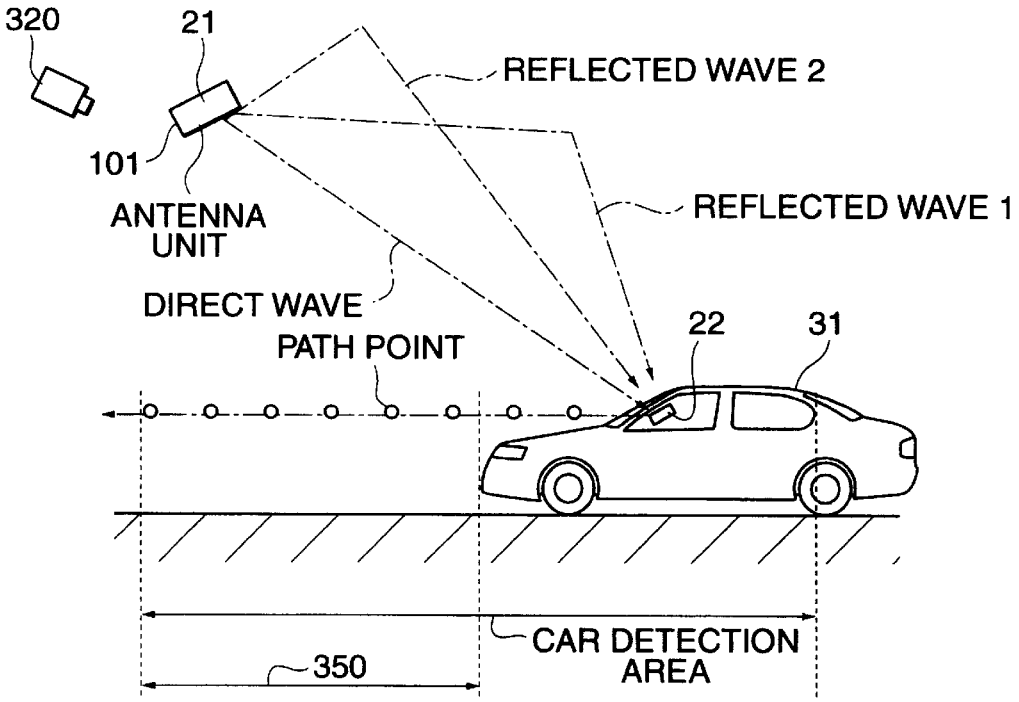

The roadside communication antenna 21 communicates with the vehicle-mounted antenna 22 in the car approaching the tollgate 300 through radio signals under the control of the communication controller 25. The car sensor 320 detects not only the car present in the designed communication area 350 of the tollgate but also another car in a given area (car detection area) behind the communication area 350, as shown in FIG. 3B. The sensor uses a TV camera to take images of an approaching car periodically. The car data detector 130 is an image processor which processes images from the TV camera to determine the profile, position and speed of the car; it may be integrated with the car sensor 320 into a unit. In place of the TV camera, a laser sensor device may be used to detect the car profile and position.

Car profile data is used to calculate reflecting surface data and determine the position of a vehicle-mounted communication antenna, though it takes time to determine it accurately. In this embodiment, only rough car profile data including the length, height and width of the car is calculated and, according to this rough data, reference is made to the car type data 1530 stored in the storage 153 and the profile data nearest to the rough car profile data is sought and obtained. Here, it is assumed that the position of the vehicle-mounted communication antenna 22 is predetermined for each car type.

FIGS. 9A, 9B and 9C show car type data structures. FIG. 9A is a car type data table 1530-1 which contains such data for each car type as length, height, width and profile. FIG. 9B is a data table which shows an example of profile data, where the vertexes for each of the planes (surfaces) which make up a car profile are designated by x, y and z coordinates. At least three vertexes should be designated for each plane. When four or more vertexes are designated, the profile data should be determined so as to have all these vertexes on the same plane. Here, car profile data for all planes of a car are not required; only profile data for the reflecting planes (surfaces) which is used as reflecting surface data in calculation of electromagnetic wave paths is required.

FIG. 9C is a car type data table 1530-2 whose data structure is different from that of 1530-1. This data structure consists of pattern data and profile data for each car type, where profile data is the same as the data shown in 9B. Pattern data refers to image files as shown in FIG. 9D, which represent car type templates (i), (ii), (iii) and so on for different car types. The car data detector 130 extracts the car profile part from an image taken by the TV camera and checks its correlation with different types of car pattern data to choose the most correlative car type and accordingly refer to profile data.

The electromagnetic wave path judgment section 150 receives data on the position and profile of the detected car from the car data detector 130, distinguishes between the car in the communication area and the car outside it and defines the former as car 1 and the latter as car 2. The explanation given below assumes that only one car can be present in each of the communication area and the car detection area as an area outside it.

The electromagnetic wave path judgment section 150 calculates electromagnetic wave paths between the antenna 101 and the vehicle-mounted communication antenna 22 using reflecting surface data based on the structure of the tollgate 300 and the profile of the detected car. As shown in FIG. 3B, electromagnetic wave paths include a direct wave between the antennas which reaches either antenna directly, and reflected waves which reach either antenna after reflection from a structure or a car.

The electromagnetic wave path judgment section 150 calculates the electric field strength for each calculated electromagnetic wave path upon reception by the antenna unit 101, and selects the wave path whose field strength is the highest, among the calculated wave paths for car 1 and car 2 as described above. In other words, the electromagnetic wave path that enables the vehicle-mounted antenna to deliver the highest receiving sensitivity.

In addition, for all the calculated electromagnetic wave paths, the electromagnetic wave path judgment section 150 calculates the direction of radiation in the 3D space where radio waves are irradiated from the antenna unit 101. It defines the direction of radiation for the chosen electromagnetic wave path with the highest field strength for car 1, as radiation direction 1, and the direction of radiation for the other electromagnetic wave paths as radiation direction 2. Then, it determines the directional pattern of the electromagnetic wave beam irradiated from the antenna unit 101 so that radiation is made in radiation direction 1 with a radiant intensity of over intensity 1, and in radiation direction 2 with a radiant intensity of below intensity 2 which is well below intensity 1, and controls the directivity controller 111 in the roadside antenna 21 according to this determined pattern.

The directivity controller 111 adjusts the feed power level or radiation angle for the antenna unit 101, or makes an antenna selection in order to obtain the directional pattern as determined by the electromagnetic wave path judgment section 150. As a result, the directional beam profile for the antenna unit 101 is adjusted so that the maximum radiation is directed toward the vehicle-mounted communication antenna in the communication area and the directional beam radiation null point is directed toward the vehicle-mounted communication antenna outside the communication area.

Next, the constituent parts of the system and their operations will be described in detail. The antenna unit 101 is either an array antenna composed of plural antenna elements, or a unit antenna composed of pencil beam antennas. In case of the former, the directivity controller 111 controls the power feed according to the directional pattern determined by the electromagnetic wave path judgment section 150 or the feed factor (amplitude and phase of electric power) for each antenna element. In case of the latter, the directivity controller 111 adjusts the directional pattern to the one determined by the electromagnetic wave path judgment section 150, by changing the pencil beam antenna to be connected with the communication controller 25.

Figure 4:
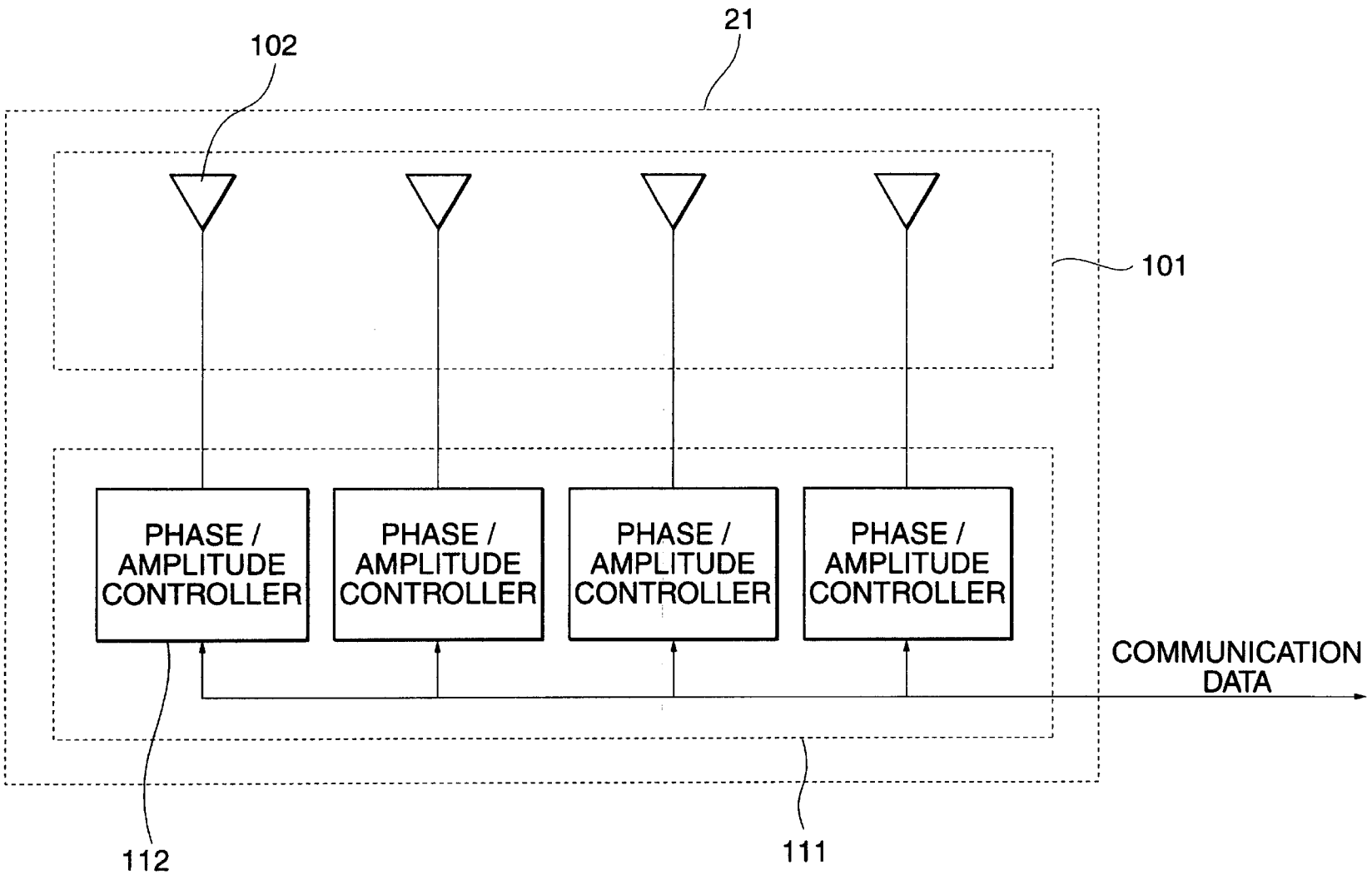
FIG. 4 shows one example of a roadside communication antenna as a unit which consists of an array antenna and a directivity controller.

FIG. 4 shows the structure of the array antenna combined with the directivity controller. The antenna unit 101 is composed of plural antenna elements 102 while the directivity controller 111 consists of plural phase/amplitude controllers 112. When a radio signal is sent, the phase/amplitude controller 112 feeds electric power with the feed factor specified by the electromagnetic wave path judgment section 150 to excite the antenna elements 102 to control the directional beam profile so that radiation is made in radiation direction 1 with over intensity 1 and in radiation direction 2 with below intensity 2. For a signal that is received by the antenna unit 101, the beam profile is also controlled in the same way.

Figure 5:
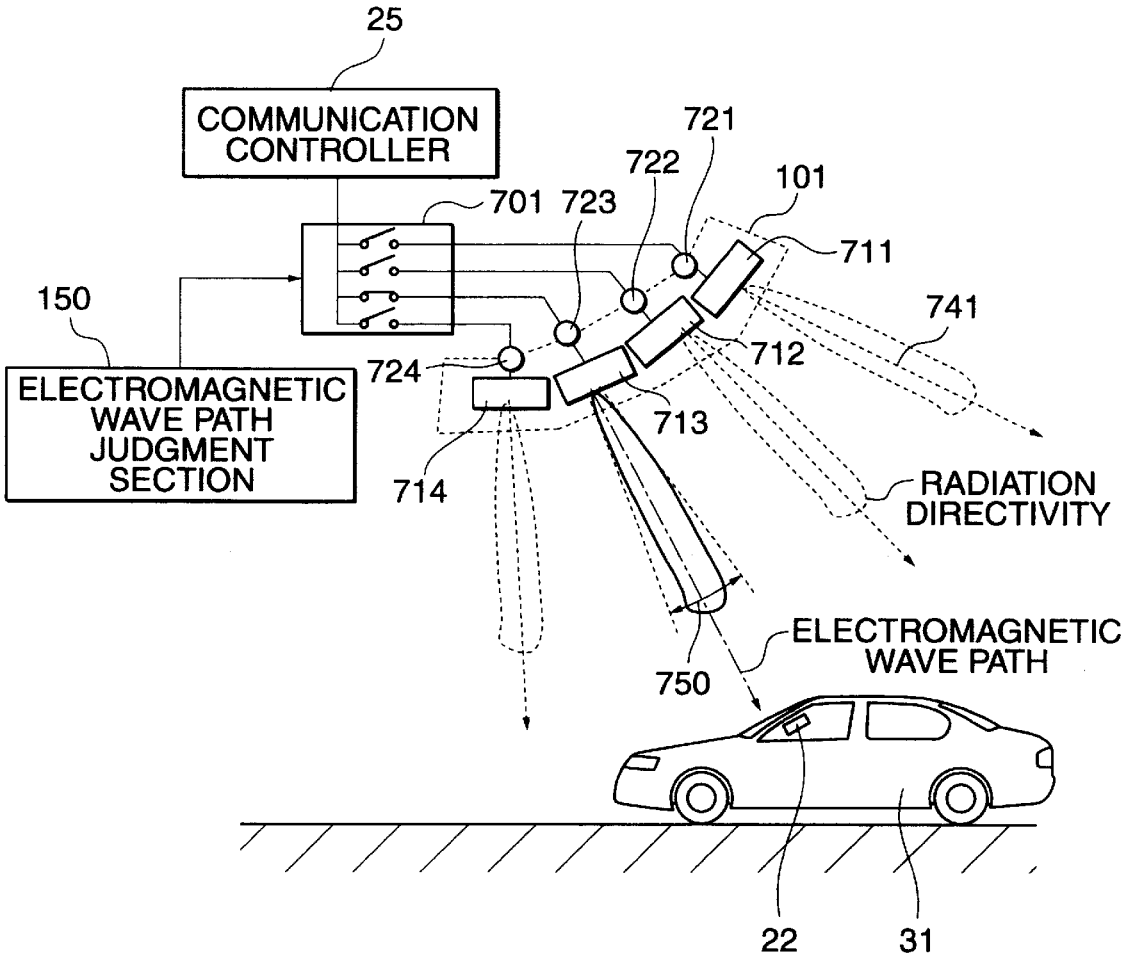
FIG. 5 shows another example of a roadside communication antenna as a unit which consists of plural pencil beam antennas and a directivity controller.

FIG. 5 shows the structure of the pencil beam antenna unit. The antenna unit 101 is composed of plural pencil beam directional antennas 711 to 714. The directivity controller 111 is composed of an antenna selector 701 and angle adjusters 721 to 724. The antenna selector 701 selects the pencil beam antenna nearest to radiation direction 1 and makes a fine adjustment of its radiation direction with the corresponding angle adjuster.

Figure 6:
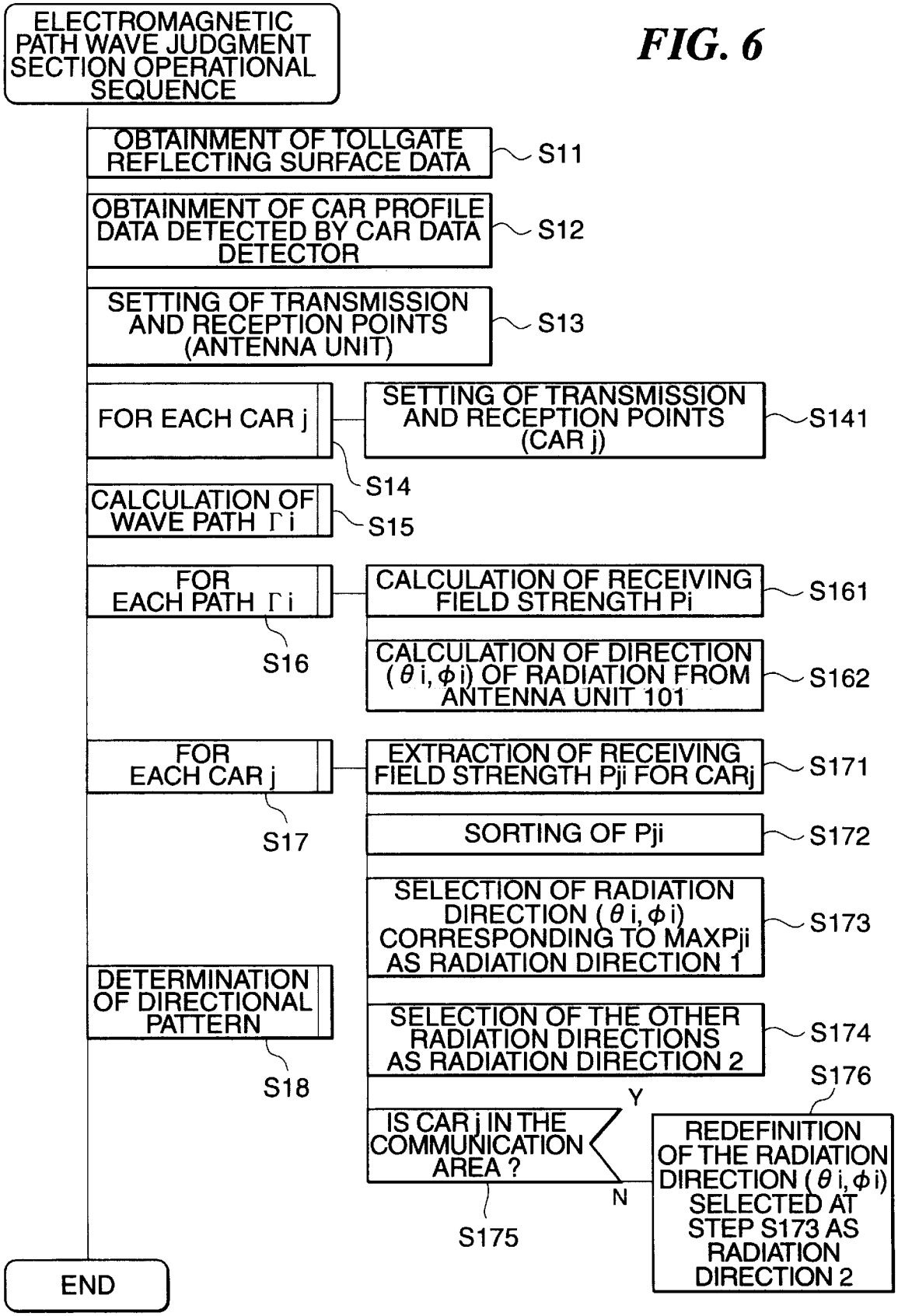
FIG. 6 is a flowchart showing an example of an operational sequence for the electromagnetic wave path judgment section.

FIG. 6 is a flowchart showing the operational sequence for the electromagnetic wave path judgment section. First, reflecting surface data for the structures of the tollgate and that for the detected car are obtained by reference to the storage 153 (S11, S12). The reflecting surface data for the structures is fixed for each tollgate and pre-analyzed and the analysis data is stored in the reflecting surface data memory (invisible in the figure) of the storage 153.

The car reflecting surface data can be obtained by extracting the same normal from the profile data of the detected car. In this embodiment, regarding car reflecting surface data, analysis has been made in advance for data on each car profile as stored in the car type data memory 1530 and stored in the reflecting surface data memory; so, when profile data for the detected car is obtained by reference to the profile data in the car type data memory 1530, reflecting surface data corresponding to the profile data can also be obtained.

Then, the points for transmission and reception of reflected waves are set (S13). Here, the transmission point is the roadside communication antenna 21, or its location in the tollgate. The position of the vehicle-mounted communication antenna 22 in the detected car is registered as the reception point for each car j (S14, S141). Data on the position of the vehicle-mounted communication antenna 22 can be obtained as supplementary data for the car type data memory 1530.

Next, under the above conditions, electromagnetic wave paths Γ i for direct and reflected waves are calculated (S15). The path of direct wave can be easily found by connecting the position of the roadside antenna 21 and that of the vehicle-mounted communication antenna 22 of the detected car in its detected position by a straight line, and geometrically checking whether there is no obstacle which blocks the line between the two positions.

On the other hand, paths of reflected waves can be calculated by a typical numerical method for electromagnetic waves. One example of such a calculation method is to use an algorithm that a reflecting surface is broken down into meshes and the current which flows in each mesh is calculated from the electromagnetic wave beam emitted from the array antenna to determine a reflected wave path. It is also possible to use the ray tracing method based on geometrical optics in which an electromagnetic wave path is determined on the assumption of specular reflection of electromagnetic waves on each reflecting surface. It should be noted that, taking into radio wave attenuation into account, a path of waves which undergo a smaller number of reflections than a given number of reflections, or a wave path effective for communication, is sought.

Then, for every calculated electromagnetic wave path, steps S161 and 162 are taken (S12). At step S161, receiving field strength Pi is calculated, and at step S162, the direction in which each wave path is emitted from the antenna unit 101 is calculated and it is expressed as a radiation direction (θ,φ) which will be defined later.

The receiving field strength Pi for each path is calculated from the following parameters: transmitting power and antenna gain for the antenna unit 101, propagation loss in the path space, loss at the reflection point, and antenna gain and receiving power for the vehicle-mounted communication antenna 22. The antenna gain for the antenna unit 101 should be such gain that enables the designed basic directional pattern in the communication area 350 to get a sufficient field strength in the communication area. For the antenna gain and receiving power for the vehicle-mounted communication antenna 22, standard values are used. A basic directional pattern refers to a radiation pattern which permits stable communication in a given position in the car detection area. This pattern involves only a direct wave or both direct and reflected waves from a structure of the tollgate.

Next, steps S171 to S176 are taken for each car j (S17). At step S171, from among receiving field strengths Pi calculated at step S161, the ones related to car j are extracted and expressed as Pji. At step S172, the Pji values are sorted in descending order and the maximum such value is expressed as MaxPji. At step 173, the radiation direction (θi, φi) which corresponds to MaxPji is selected as radiation direction 1 (θi1,φi1). At step S174, radiation directions which do not correspond to MaxPji are all defined as radiation direction 2 (θki,φki).

At step S175, whether or not there is a car j in the communication area is checked to decide the step which follows. If there is not a car j in the area, step S176 is carried out; if there is a car j in it, the process goes back to step S17 and the steps for the next car (j=j+1) are started. Step 176 is carried out to redefine, as radiation direction 2, radiation direction (θi,φi) which has been defined as radiation direction 1 at step S173 when there has been no car j in the communication area.

As discussed above, the electromagnetic wave path judgment section 150 distinguishes radiation direction 1 from radiation direction 2 and selects them as such with regard to each of electromagnetic wave paths Γi of direct and reflected waves, where radiation direction 1 refers to a direction that maximizes receiving filed strength Pji while radiation direction 2 refers to the other radiation directions.

Then, according to the selection of radiation direction 1 and radiation direction 2, the directional pattern for the antenna 101 is decided (S18). As mentioned later, after the electromagnetic wave path judgment section 150 determines the directional pattern so that the beam intensity in radiation direction 1 is maximized or over intensity 1 and that in radiation direction 2 is zero or below intensity 2, it gives the directivity controller 111 an instruction for the determined directional pattern.

In the above sequence, electromagnetic wave paths must be calculated repeatedly according to car profiles and positions. However, it is also possible that, if electromagnetic wave paths have been pre-calculated using car type data and car position data (path point in FIG. 3) as parameters, the calculation result data can be referred to later. Namely, a detection window is provided for each path point on the image, and in a real communication scene, the moment the car (image) comes into a detection window, the path memory 1531 is referred to for the path for the car. Car type data is obtained from the image taken at the first path point. This saves path calculation time in the electromagnetic wave path judgment section 150 and permits quick antenna directivity control which follows movements of successive cars entering the tollgate.

FIGS. 10A and 10B show the data structures of the path memory. As seen in FIG. 10A, the path memory stores a path data file (path i, j) and a directional pattern file (dipat i, j) for each of path points x1, x2 and so on with respect to each car type. According to FIG. 10B, regarding electromagnetic wave paths 1 to 5, their radiation directions, whether the wave is direct or reflected, and receiving field strengths are calculated in advance, for instance, for a car of car type 1 at path point x1, and stored in path data file (path1,1).

Thus, the results of pre-calculations for plural combinations of car type and position data parameters by the electromagnetic wave path judgment section 150 are stored in the path memory 1531 as data available for reference in order to simplify the calculation of electromagnetic wave path Γi. In actual communication, it is also acceptable that, without relying on predetermined path points, the data for the car position closest to the car position detected by the car data detector 130 is searched from the path memory 1531 to select radiation direction 1 or 2.

Although only path data for the current car (car in the communication area) is shown in FIGS. 10A and 10B, it is also possible to add car type data and car position data (distance from the current car) for the next car as parameters and get path data for the next car beforehand. Since the next car is outside the communication area and the path calculation for the next car is only intended to prevent erroneous communication, it is sufficient to make a path calculation for just one next car or so and a relatively short distance from the current car (such a distance that the field strength for direct or reflected waves reaching the next car may be larger than that in radiation direction 1 for the current car); therefore the number of possible parameter combinations can be reduced to the extent that the calculation is possible.

Figure 7:
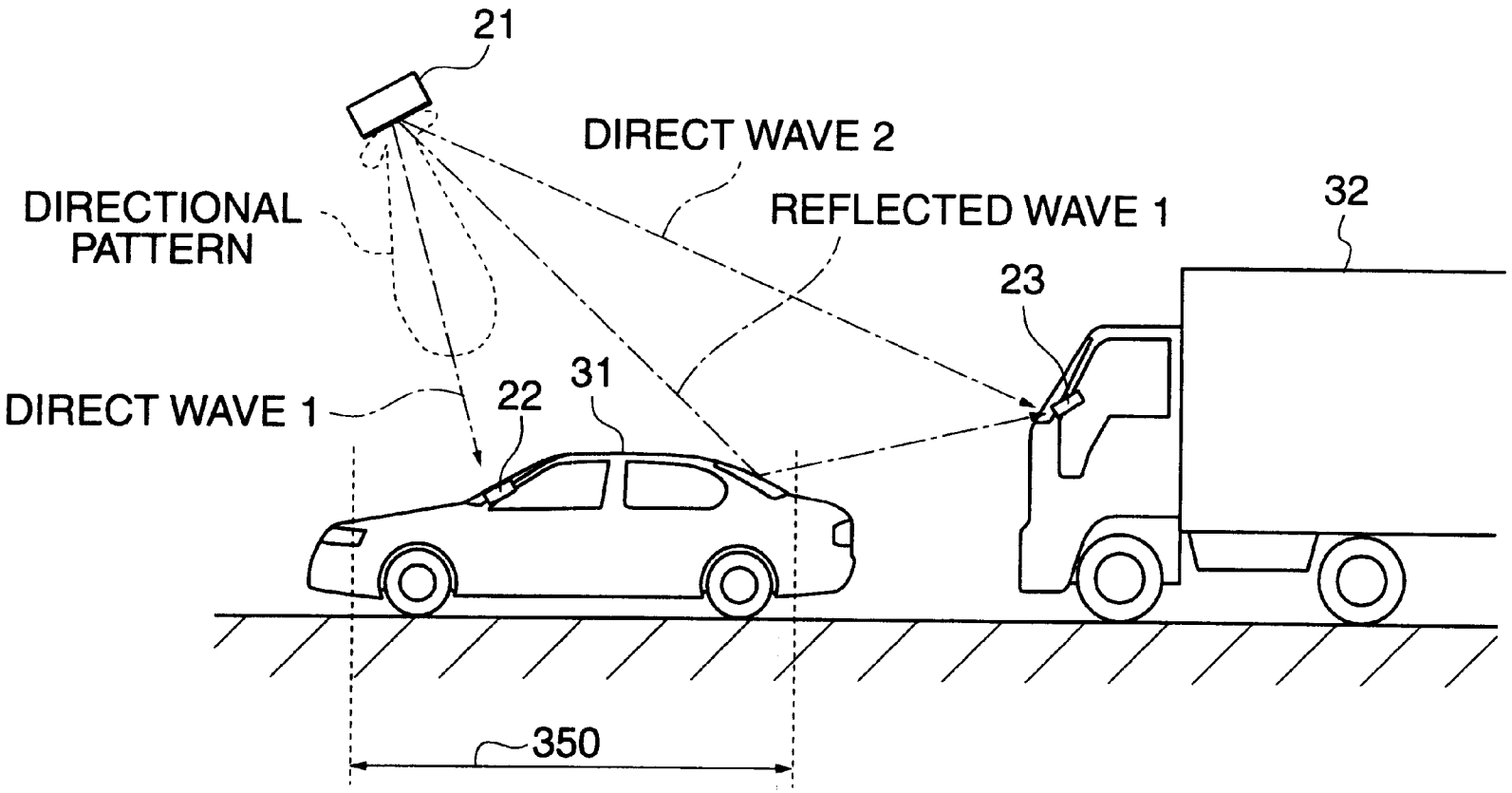
FIG. 7 illustrates a directional pattern, radiation direction 1 and radiation direction 2.

FIG. 7 illustrates the basic directional pattern, radiation direction 1 and radiation direction 2. As indicated here, a car 31 which has been detected in the car detection area 130 is in the communication area 350 while a car 32 is outside the communication area. There are three electromagnetic wave paths for the roadside communication antenna 21, the vehicle-mounted communication antenna 23 in the car 32, and the vehicle-mounted communication antenna 22 in the car 31: direct wave 1, direct wave 2 and reflected wave 1. In this case, the basic directional pattern for the roadside communication antenna 21 with respect to the communication area 350 is assumed to be as expressed by the dotted line in the figure.

Direct wave 1 represents a direct path between the roadside communication antenna 21 and the vehicle-mounted communication antenna 22 and runs in the main radiation direction for the directional pattern of the roadside communication antenna 21. Direct wave 2 represents a direct path between the roadside communication antenna 21 and the vehicle-mounted communication antenna 23 and runs in the sub radiation direction for the directional pattern of the roadside communication antenna 21. Reflected wave 1 represents a wave path from the roadside communication antenna 21 which is reflected from the car 31 and reaches the vehicle-mounted communication antenna 23, and runs in the main or sub radiation direction for the directional pattern of the roadside communication antenna 21.

The electromagnetic wave path judgment section 150 selects direct wave 1 for radiation direction 1 for the car 31, and direct wave 2 for radiation direction 1 for the car 32 at step S173. At step S174, it selects indirect wave 1 for radiation direction 2 for the car 32. However, if the receiving field strength for indirect wave 1 is larger than that for direct wave 2, radiation direction 1 for the car 32 is indirect wave 1. At step S176, for the car 32, radiation direction 1 becomes radiation direction 2 because the car 32 is outside the communication area. As a consequence, direct wave 1 is selected for radiation direction 1 in the situation shown in FIG. 7.

Next, the step of directional pattern determination by the electromagnetic wave path judgment section 150 (S18) will be explained, assuming that an array antenna or a pencil beam antenna unit is used.

Figure 8:
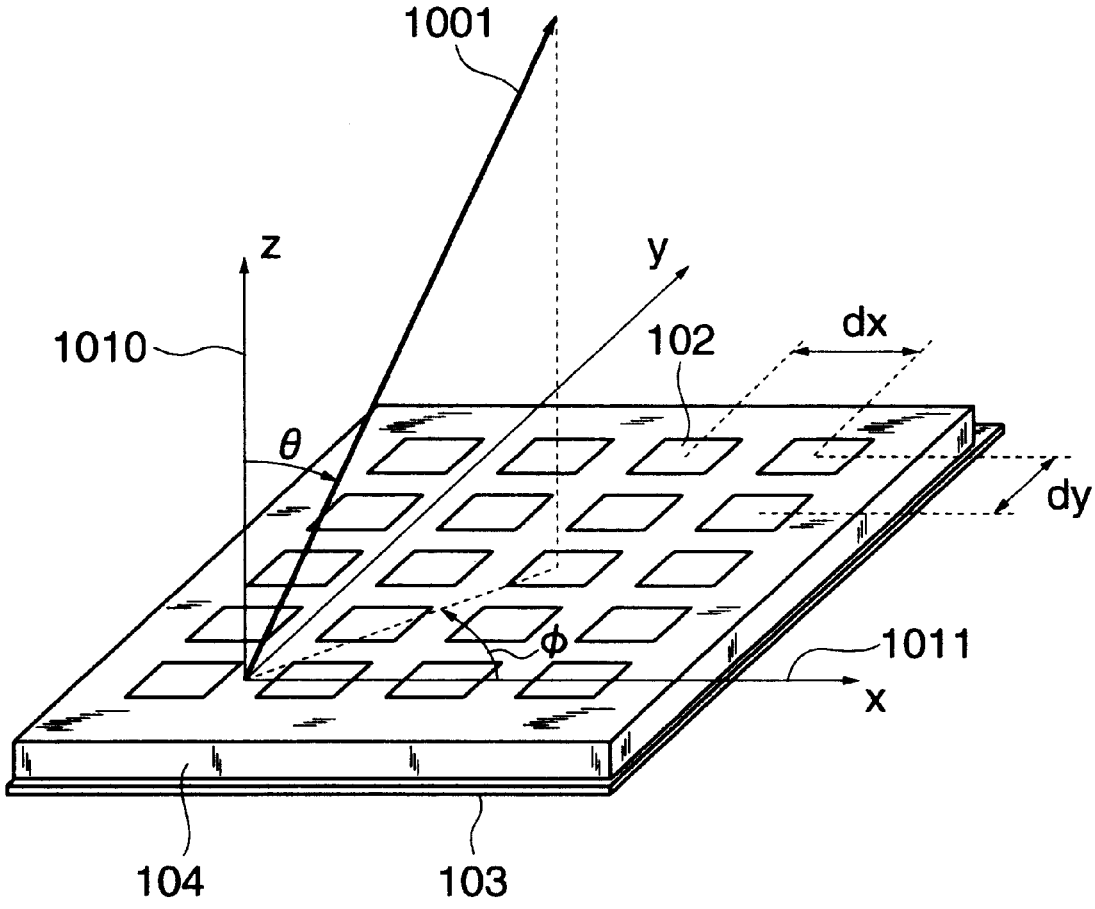
FIG. 8 illustrates the structure of an array antenna and a radiation direction.

FIG. 8 shows the structure of an array antenna composed of plane elements. A dielectric substrate 104 and antenna elements 102 which are mounted on a grounding board 103 constitutes an array antenna 101. The feed factor (amplitude and phase) for power to be fed to each antenna element is adjusted by a corresponding phase/amplitude controller 112 shown in FIG. 4.

Assume that:

x and y coordinate axes is taken with a desired point as the origin of coordinates on the antenna plane on which the antenna elements are arranged;

a z axis is vertically taken to the antenna plane in a manner that it extends through the dielectric substrate 104 from the grounding board 103; and power is irradiated from the array antenna 101 in a certain transmission direction 1000 on the x, y and z coordinate axes, the direction 1000 is expressed by angle θ from the x axis on the x/y coordinate plane and angle θ from the z axis. Radiation direction 1 and radiation direction 2 as mentioned above can also be defined by angles θ and ϕ (θ,ϕ).

Supposing that M antenna elements and N antenna elements are arranged in the x and y axis directions on the antenna plane, with element intervals $d_x$ and $d_y$, respectively, the x and y coordinates for each antenna element 102 are expressed as ($md_x$, $nd_y$), where m=0, 1, 2, . . . , M-1; and n=0, 1, 2, . . . , N-1. When the feed factor for each antenna element is expressed as $V_{mn}$ and the power radiation from the array antenna unit 101 in the transmission direction 1000 is observed from far away enough, the power irradiated in the direction expressed as (θ,ϕ) or radiation pattern E (θ,ϕ) is represented by equation 1.

$$E(\theta, \phi) = \sum_{n=0}^{N-1} \sum_{m=0}^{M-1} V_{mn} \exp\{jk_0(mu + nv)\} \qquad \text{Eq. 1}$$

where $u=k_0\sin\theta\cos\phi$, $v=k_0\sin\theta\cos\phi$, $k_0$ is a carrier frequency wave number and j is an imaginary number. Equation 1 suggests that the electromagnetic wave emitted from each antenna element excited with a specified feed factor, with its phase changing according to the radiation angle, is combined with other such waves to form a radiation pattern.

Equation 1 takes the form of Fourier transform. Conversely, as a method using a Fourier transform pair, the feed factor $V_{mn}$ can be found by giving as many radiation patterns E (θ,ϕ) as antenna elements (M×N). Therefore, if radiation patterns E (θk,ϕl) are given (where k=0, 1, 2, . . . , M-1; and l=0, 1, 2, . . . , N-1), feed factor $V_{mn}$ can be calculated from the following equation 2:

$$V_{mn} = \frac{1}{NM} \sum_{l=1}^{N-1} \sum_{k=0}^{M-1} \exp\{jk_0(mu_k + nv_1)\} E_{kl}(\theta, \phi) \qquad \text{Equation 2}$$

suggests that feed factor $V_{mn}$ is determined by the absolute value and phase angle calculated by giving radiant intensity Kkl (θk,ϕ1) with regard to M×N directions(θk,ϕ1).

This means that, when Ekl(θ,ϕ) is determined given E1 for radiation direction 1 (θi,ϕi) and E2 for radiation direction 2 (θh,ϕh), the feed factor of power irradiated with E1 for radiation direction 1 and E2 for radiation direction 2 can be calculated using equation 2. In this case, the intensity 1 and intensity 2 correspond to E1 and E2, respectively. Practically, 10×10 or a similar quantity of antenna elements are sufficient.

The directivity controller 111 supplies power with the amplitude and phase specified by feed factor $V_{mn}$ calculated using equation 2, to each antenna element 102 through the corresponding phase/amplitude controller 112 and changes the directional beam emitted from the array antenna 101 from the basic directional pattern to such a pattern that makes the intensity in radiation direction 1 over intensity 1 and that in radiation direction 2 below intensity 2.

In this embodiment, feed factors $V_{mn}$ for plural directional beam profiles are pre-calculated with radiation directions 1 and 2 as parameters and stored in the directional pattern memory 1532 of the storage 153. After the electromagnetic wave path judgment section 150 selects radiation direction 1 and radiation direction 2, it reads out, from the memory, the directional pattern which provides radiation directions 1 and 2 most similar to the selected ones and sends its feed factor to the directivity controller 111.

FIG. 11 shows the data structure of the directional pattern table. In this embodiment, the directional pattern table 1532 contains feed factors $V_{mn}$ (amplitude and phase) for the respective antenna elements which are pre-calculated for the respective path data files concerning car type and position x, as directional pattern files (dipat i, j) in the path memory 1531 shown in FIG. 10A.

The structures of the array antenna 101 and directivity controller 111 or the method for finding $V_{mn}$ from a specified directional beam profile, as used in this embodiment, can be realized, for example, by using the array antenna and directivity synthesis method as stated on pages 80 through 92 of "Shin antena kogaku" (new antenna engineering) authored by Hiroyuki Arai (published by Sogo Denshi Shuppan in 1996) or the method or the like as stated in Chapter 9 of "Antena no kisoriron to sekkeiho" (basic theory and design method of antennas) authored by Kohei Hongo (published by Realize in 1993).

Next, how to control the directional pattern using pencil beam antennas as shown in FIG. 5 will be explained. As the electromagnetic wave path judgment section 150 selects radiation direction 1 (θi,φi) and radiation direction 2 (θh,φh), it refers to the directional pattern memory 1532 in which basic directional patterns for pencil beam antennas in the array antenna unit 101 are stored in advance, and specifies the pencil beam antenna whose radiation direction (θl,φt) is most similar to the selected ones (step S18) and sends the relevant directional pattern data together with data on radiation directions 1 and 2 to the directivity controller 111.

The antenna selector 701 in the directivity controller 111 connects the specified pencil beam antenna t with the communication controller 25. The angle adjuster for the specified pencil beam antenna t is adjusted so that radiation direction 1 (θi,φi) coincides with the radiation direction (θt,φt) of the antenna t. Or, the angle adjuster for the specified antenna t is adjusted so that the intensity in radiation direction 2 (θh,φh) is null or below intensity 2.

As discussed so far, according to this embodiment, as a car approaching the tollgate is detected, the above-mentioned operational sequence is effectively followed to ensure stable communication with the car in the communication area while suppressing interference by reflected waves, and thereby perform automatic charging with accuracy. The sequence is as follows: all direct and indirect paths of electromagnetic waves between the roadside antenna and the vehicle-mounted antenna are calculated; the radiation direction which provides the highest electric field strength and corresponds to the path of radio waves to the car in the communication area is defined as radiation direction 1 and the direction which corresponds to other radio wave paths as radiation direction 2; and then the roadside antenna directional pattern is adjusted so that radiation power E (θ,φ) in radiation direction 1 is maximized or over intensity 1 and radiation power E (θk,φk) in radiation direction 2 is 0 or below intensity 2.

As a variation of this embodiment, the system may allow more than one car j to be present in the designed communication area and enable communication with plural cars concurrently. In this case, consequently the electromagnetic wave path judgment section 150 selects more than one radiation direction 1 (θji,φji), and the directivity controller 111 connects more than one pencil beam antenna for the radiation directions 1 with the communication controller 25 and adjusts the angle adjuster for each connected antenna to suppress the radiation power in radiation direction 2.

In this embodiment, the communication controller 25 starts communication just after control is performed by the electromagnetic wave path judgment section 150 and directivity controller 111. In other words, at each time of periodic sampling by the car sensor 320 or the moment the head of the detected car passes each path point in the communication area 350 as shown in FIG. 3B, the electromagnetic wave path judgment section 150 and the directivity controller 111 begin operating; then upon optimization of the radiation pattern of the antenna unit 110, the communication controller 25 starts communication with the car and the communication continues at least until the process of charging the car is finished.

At the next sampling time, or at the next path point, since the car's position has been changed, again the electromagnetic wave path judgment section is activated to readjust the radiation pattern of the antenna unit 110. Although the communication continues during this readjustment, no communication trouble can occur because an once optimized radiation pattern can only undergo a fine adjustment.

The communication controller 25 and the electromagnetic wave path judgment section 150 are connected by a binary signal line 160. The communication controller 25 sends the electromagnetic wave path judgment section 150, through the binary signal line 160, a high voltage signal during its communication with the vehicle-mounted communication antenna, and a low voltage signal while they are not communicating with each other, thereby enabling the judgement section 150 to stop its operation after the communication is over.

According to this embodiment, after a desirable electromagnetic wave path to a car in the communication area is acquired, if radio communication with the car in the communication area is not established, it is thought that the car has no vehicle-mounted antenna or the vehicle-mounted antenna is not ON. In this case, the system considers the car as not having a vehicle-mounted antenna properly and judges it unsuitable for automatic toll collection, and treats it as such, for example, by giving a warning.

Thus, the present invention produces the effect that the roadside communication antenna is controlled so as to obtain the required sensitivity for communication only with one car present in the designed communication area, while suppressing reflected radio waves from a structure or a car in the tollgate area, so that communication failures or errors can be prevented and charging or toll collection at the tollgate can be accurately performed through radio waves.

Also, the radiation pattern of the roadside antenna is adjusted so as to prioritize a required electromagnetic wave path and suppress unrequired electromagnetic wave paths, so restrictions on the structure of a tollgate as placed so far can be relaxed and the construction or operating cost can be reduced.

The present invention is not limited to the above embodiments and various changes and modifications can be made within the spirit and scope of the present invention. Therefore, to appraise the public of the scope of the present invention, the following claims are made.

What is claimed is:

1. A toll collection system communication method which charges a car passing through a communication area in a tollgate without a stop, by radio communication between a roadside antenna in the tollgate and a vehicle-mounted antenna in the car, the method comprising the steps of:

detecting a car passing through a detection area including a communication area and a given area just before the communication area;

calculating, when a car is present in the communication area, a plurality of electromagnetic wave beam paths of direct and reflected waves which connect the roadside antenna and the vehicle-mounted antenna;

selecting a radiation direction of the wave beam paths whose communication sensitivity is the highest among the wave beam paths as radiation direction 1;

defining the radiation direction of the wave beam paths other than the beam paths in the radiation direction 1 to cars outside the communication area as radiation direction 2; and controlling a directional pattern of the roadside antenna so that the intensity of the beam in the radiation direction 1 is over a first intensity, and that of the beam in the radiation direction 2 is below a second intensity of an intensity which disables communication.

2. The toll collection system communication method according to claim 1, further comprising the steps of:

calculating, when two or more cars are detected in the detection area, a plurality of wave beam paths of direct and indirect waves for the respective cars; and selecting all wave beam paths other than the wave beam paths to the cars outside the communication area as ones for the radiation direction 2.

3. The toll collection system communication method according to claim 1, further comprising:

obtaining data regarding a car profile of the detected car in the detection area; and calculating the wave beam paths by reference to car reflecting surface data for the car profile concerned and reflecting syrface data for the tollgate.

4. The toll collection system communication method according to claim 1, wherein the process of calculating the wave beam paths begins when a car enters the communication area.

5. The collection system communication method according to claim 1, wherein if no radio communication with a car which enters the communication area is established, the car is considered as not having a proper vehicle-mounted antenna.

6. A toll collection system comprising:

a car sensor for detection of a car in a given area including a designed communication area at a tollgate; and roadside communication antenna equipment having a roadside antenna and a directional pattern controller for changing its directional pattern, wherein charging is performed by radio communication between the roadside antenna and a vehicle-mounted antenna in an entering car without a stop, the system further comprising:

an electromagnetic wave path judgement section:

for calculating wave beam paths between the roadside antenna and the vehicle-mounted antenna according to data regarding a structure of the tollgate, a car profile and car position detected by the car sensor, and for selecting a radiation direction of the wave beam paths whose communication sensitivity is the highest among the wave beam paths as a radiation direction 1, and selecting all wave beam paths other than the wave beam paths to cars outside the communication area as the wave beam paths in a radiation direction 2 of disabled communication.

7. The toll collection system according to claim 6, wherein the car sensor is provided with a TV camera and images taken by the camera are processed to determine the profile of the car.

8. The toll collection system according to claim 6, further comprising:

a storage for storing gate reflecting surface data based on the structure of the tollgate and different types of car reflecting surface data for different vehicle profiles, wherein the electromagnetic path judgment sections obtains, from the storage, the gate reflecting surface data and the car reflecting surface data corresponding to the detected car profile, to calculate both a path of a direct wave between the roadside antenna and the vehicle-mounted antenna and a plurality of wave beam paths of reflected waves.

9. The toll collection system according to claim 6, comprising:

a storage for storing pre-calculated wave beam paths concerning a plurality car profiles, wherein the electromagnetic wave beam path judgment ssection obtains, from the storage, precalculated wave beam paths appropriate to the profiles.

10. The toll collection system according to claim 6, wherein the electromagnetic wave path judgement section:

calculates the radiant intensities of the plurality of wave beam paths selects a radiation direction of the wave beam paths which has the highest radiant intensity as radiation direction 1, and determines a directional pattern which enables communication in the radiation direction 1 only.

11. The toll collection system according to claim 10, further comprising:

a storage for storing pre-calculated directional patterns as a plurality of combinations of variations of the radiation directions 1 and 2, wherein the electromagnetic wave path judgment section obtains a directional pattern appropriate to the selected radiation directions 1 and 2 from the storage.

12. The toll collection system according to claim 6, wherein the roadside antenna is an array antenna having a plurality of antenna elements, and the directional pattern is changed by controlling the amplitude and phase of power fed to the array elements.

13. The toll collection system according to claim 6, wherein:

the roadside antenna is an antenna unit which has a plurality of selectable pencil beam antennas arranged so as to emit beams in different directions, and the directional pattern is changed by selecting the pencil beam antenna whose radiation direction is nearest to the radiation direction of the prioritized wave beam path.

14. A toll collection system communication method which charges a car passing through a communication area in a tollgate, by radio communication between a roadside antenna in the tollgate and a vehicle-mounted antenna in the car, the method comprising the steps of:

detecting a car passing through a detection area including the communication area and a given area just before the communication area;

calculating, when a car is present in the communication area, a plurality of electromagnetic wave beam paths of direct and reflected waves which connect the roadside antenna and the vehicle-mounted antenna;

calculating, when two or more cars in the detection area are detected, a plurality of the wave beam paths for the respective cars;

selecting a radiation direction of the wave beam paths whose communication sensitivity is the highest among the wave beam paths as radiation direction 1; and selecting the radiation of all wave beam paths other than the wave beam paths to the cars outside the communication area as a radiation direction 2 of disabled communication.

* * * * *